US006602211B2

(12) United States Patent
Tucek

(10) Patent No.: US 6,602,211 B2
(45) Date of Patent: Aug. 5, 2003

(54) CHIROPRACTIC ADJUSTOR APPARATUS

(75) Inventor: Kevin B. Tucek, Mesa, AZ (US)

(73) Assignee: Erchonia Patent Holdings, LLC, Mesa, AZ (US)

( * ) Notice: Subject to any disclaimer, the term of this patent is extended or adjusted under 35 U.S.C. 154(b) by 0 days.

(21) Appl. No.: 10/174,622

(22) Filed: Jun. 19, 2002

(65) Prior Publication Data

US 2003/0014079 A1 Jan. 16, 2003

Related U.S. Application Data

(63) Continuation-in-part of application No. 09/749,023, filed on Dec. 26, 2000, now Pat. No. 6,537,236.

(51) Int. Cl.[7] ..... A61H 1/00

(52) U.S. Cl. ..... 601/97; 601/101; 601/107; 601/111; 606/237; 606/238; 606/239

(58) Field of Search ..... 601/97, 101, 103, 601/107, 108, 110, 111; 606/237, 238, 239

(56) References Cited

U.S. PATENT DOCUMENTS 4,016,873 A * 4/1977 Anderson ..... 601/107
4,461,286 A * 7/1984 Sweat ..... 606/238
4,549,535 A * 10/1985 Wing ..... 601/108
4,716,890 A * 1/1988 Bichel ..... 601/108
4,841,955 A * 6/1989 Evans et al. ..... 601/101
5,618,315 A * 4/1997 Elliott ..... 606/237
6,228,042 B1 * 5/2001 Dungan ..... 601/107
6,503,211 B2 * 1/2003 Frye ..... 601/107

* cited by examiner

*Primary Examiner*—Nicholas D. Lucchesi
*Assistant Examiner*—Quang D Thanh
(74) *Attorney, Agent, or Firm*—Etherton Law Group, LLC; Sandra L. Etherton

(57) ABSTRACT

A chiropractic adjustor apparatus having an electromagnetic drive mechanism connected to an actuating means which causes a shaft to reciprocate. The reciprocating shaft is used to apply pressure or force directly to the spinal vertebrae of a body. The improvements of this device include a variable-controlled switch to enable the user to change the frequency of the reciprocation; a thermal cut-off switch that automatically turns off the power to the electromagnetic drive mechanism so that the device will stop reciprocating; and a suite of structures that work together to resist rotation when the device is in use.

9 Claims, 7 Drawing Sheets

CHIROPRACTIC ADJUSTOR APPARATUS

CROSS-REFERENCE TO RELATED APPLICATIONS

This application is a continuation-in-part (CiP) of U.S. application Ser. No. 09/749,023 filed Dec. 26, 2000, now U.S. Pat. No. 6,537,236.

FIELD OF THE INVENTION

The present invention generally relates to a chiropractic adjustor apparatus used to apply vibratory energy or force to a patient and, more particularly, relates to a chiropractic adjustor apparatus having an improved ability to resist overheating and rotation during use.

BACKGROUND OF THE INVENTION

Chiropractic adjustments of the spinal vertebrae of a body involve the application of pressure or force in a known manner directly to the body by the hands of a chiropractor or by a chiropractic adjustor apparatus. Examples of such chiropractic adjustor apparatuses found in the prior patent art are those disclosed in U.S. Pat. No. 4,716,890 to Bichel and U.S. Pat. No. 4,841,955 to Evans et al.

Another example of a prior art chiropractic adjustor apparatus is the one illustrated in FIG. 1. The apparatus of FIG. 1 includes a housing, a handle on the housing, a trigger reciprocally mounted to the handle, an electronic control module provided in the handle and activated by depression and release of the trigger, an elongated force-transmitting shaft reciprocally mounted through the housing. An electromagnetic drive mechanism is disposed in the interior cavity of the housing and connected electrically to an electronic module. It is operable by the actuation of the trigger and the return action of a compressible spring near the rear portion of the housing, causing the shaft to transmit vibratory energy to the human body.

The electromagnetic drive mechanism includes a spool with electrical windings stationarily supported in the interior cavity of the housing and a stator mounted on the shaft and disposed within a bore of the spool in an electromagnetically coupled relationship with the electrical windings about the spool. Depressing the trigger activates the electrical control module to apply predetermined pulses to the electrical windings so as to actuate the stator and thus the shaft into repetitive reciprocal vibratory type of movement along a longitudinal axis of the shaft and relative to the housing. However, the prior art provides only a single frequency of the reciprocation. This prevents the treatments from being customized to the patient's need. It is desirable to provide variable frequencies for use with various treatment regimens.

The operation of the electromagnetic drive mechanism creates substantial heating of the electrical windings which, in turn, heats the portions of the housing adjacent thereto. The buildup of heat must be dissipated from the housing in order to prevent overheating of the handle connected thereto and of the electronic control module disposed in the handle. Unsatisfactory dissipation of the heat would make it uncomfortable and difficult for the operator to hold onto the handle for an extended period of time and have the potential to cause a malfunction of the electronic control module. A plurality of passages are provided through the rear portion of the housing to facilitate passage and dissipation of heat from the drive mechanism and housing. It is desirable to provide a thermal cut-off switch to prevent the device from overheating and causing damage to the device.

During operation, the prior art devices tend to rotate, or twist, out of the user's grip, as a result of the rotational components of the force exerted on the shaft by the electromagnetic drive mechanism, causing the operator to exert much effort in holding the device substantially perpendicular to the patient's vertebrae. It is desirable to provide means to resist such rotation so that the device can be held in the proper position along the patient's spine.

Consequently, a need exists for an innovation that will provide a configuration that will overcome the aforementioned problems of the prior art. Therefore, it is an object of this invention to provide a device that provides a variable frequency of reciprocation. It is another object of this invention to provide a device with an improved ability to resist overheating. It is another object of this invention to provide a device that resists rotation during use.

SUMMARY OF THE INVENTION

The present invention is a chiropractic adjustor apparatus having an electromagnetic drive mechanism connected to an actuating means which causes a shaft to reciprocate. The reciprocating shaft is used to apply pressure or force directly to the spinal vertebrae of a body. The improvements of this device include a variable-controlled switch to enable the user to change the frequency of the reciprocation; a thermal cut-off switch that automatically turns off the power to the electromagnetic drive mechanism; easily interchangeable force-transmitting elements; and a suite of structures that work together to resist rotation when the device is in use.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1B:
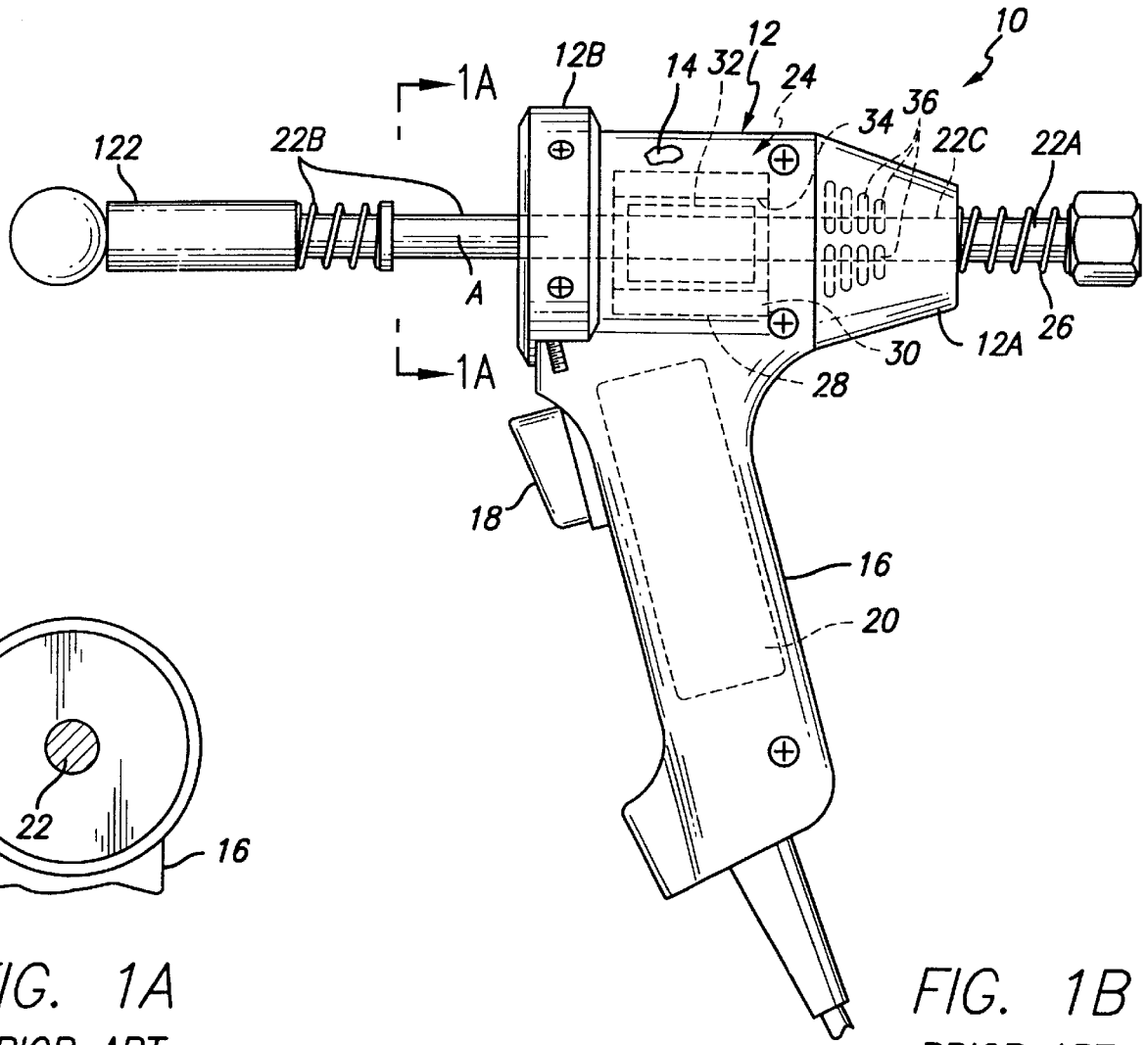
FIG. 1B PRIOR ART
FIG. 1 is a side elevational view of the prior art chiropractic adjustor apparatus that has been described in detail in the background section of this application.
FIG. 1A is an end elevational view as seen along line 1A—1A of FIG. 1.
Figure 1A:
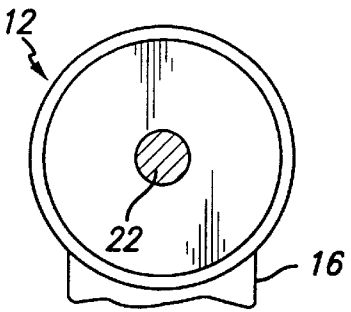
FIG. 1A PRIOR ART
Figure 2:
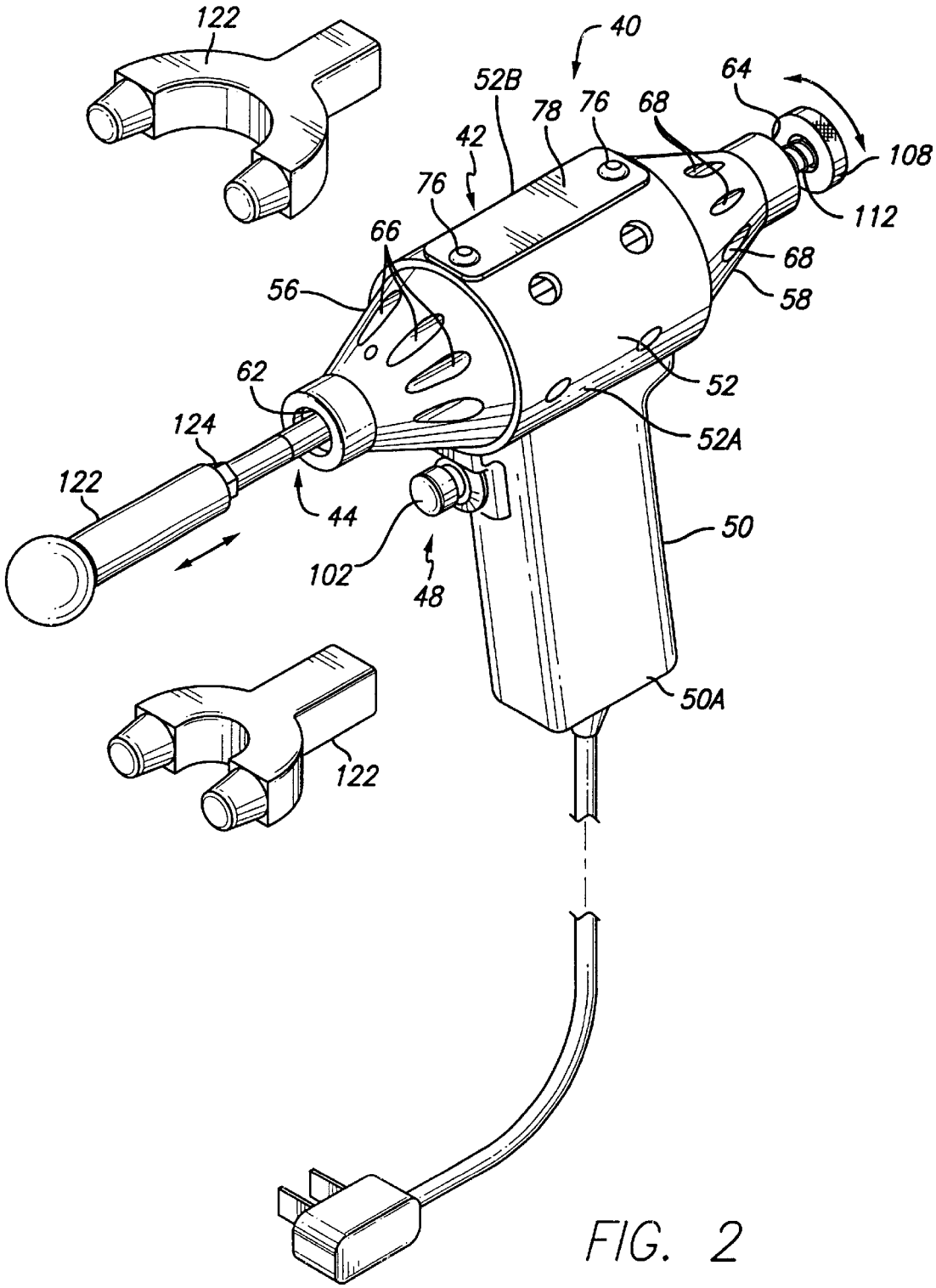
FIG. 2 is a perspective view of one embodiment of the present invention showing different heads that can be used with the chiropractor adjustor apparatus.

Referring to the drawings and particularly to FIGS. 2 to 11, there is illustrated a chiropractic adjustor apparatus of the present invention, generally designated 40. The apparatus 40 of the present invention basically includes a housing 42, an elongated force-transmitting shaft 44, an electromagnetic drive mechanism 46, an actuating arrangement 48 and a gripping means in the form of a handle 50.

The housing 42 of the apparatus 40 has a middle portion 52 defining a central interior cavity 54 and a pair of opposite (or front and rear) end portions 56, 58 merging from the middle portion 52. The opposite end portions 56, 58 are substantially mirror images of one another and oriented substantially the reverse of one another relative to the middle portion 52 so as to extend in opposite directions from the interior cavity 54. The opposite end portions 56, 58 are spaced apart from one another by the middle portion 52 and together with the middle portion 52 are coaxially aligned with one another about a longitudinal axis 60 of the housing 42. Each of the opposite end portions 56, 58 has a central opening 62, 64 and a plurality of axially extending passages 66, 68. The central openings 62, 64 of the respective opposite, or front and rear, end portions 56, 58 are aligned with one another and extending parallel with the longitudinal axis 60 of the housing 42. The passages 66, 68 of each plurality thereof are circumferentially spaced apart from one another about and radially arranged outwardly from the longitudinal axis 60 of the housing 42. Such passages 66, 68 are adapted to enhance heat dissipation from the housing 42. The middle portion 52 of the housing 42 is substantially cylindrical in shape and the opposite (or front and rear) end portions 56, 58 of the housing 42 are reversely-oriented and substantially conical in shape. More particularly, the housing 42 is formed by a pair of substantially identical (front and rear) housing parts 42A, 42B are arranged in a mirror-image back-to-back relationship and in a reverse orientation with one another so as to define together the central interior cavity 54. The housing parts 42A, 42B are assembled together by a first pair of screws 70 which fixedly attach the handle 50 on a lower side 52A of the housing 52 via alignable holes 72, 74 defined in the handle 50 and the lower side 52A of the middle portion 52 of the housing 42 such that the handle 50 underlies and bridges the housing parts 42A, 42B and by a second pair of screws 76 which fixedly attach a curved plate 78 on an upper side 52B of the middle portion 52 of the housing 42 via alignable holes 80, 82 defined in the plate 78 and the upper side 52B of the middle portion 52 of the housing 42 such that the curved plate 78 overlies and bridges the housing parts 42A, 42B. The handle 50 also has an interior compartment 84.

The elongated force-transmitting shaft 44 extends through the electromagnetic drive mechanism 46, through the middle portion 52 and interior cavity 54 of the housing 42, and through the central openings 62, 64 in the opposite (front and rear) end portions 56, 58 of the housing 42. In such manner, the shaft 44 is reciprocally supported by the opposite end portions 56, 58 of the housing 42, preferably in a substantially symmetrical relationship to the electromagnetic drive mechanism 46. The shaft 44 defines a longitudinal axis 86 which extends coaxially along the longitudinal axis 60 of the housing 42. More particularly, the shaft 44 has a middle portion 44A disposed in the interior cavity 54 of the housing 42 and a pair of opposite (or forward and rearward) portions 44B, 44C extending in opposite directions from the interior cavity 54 and through and outwardly from the central openings 62, 64 of the opposite (or front and rear) end portions 56, 58 of the housing 42. A pin 88 is mounted across the forward portion 44B of the shaft 44 in a transverse relationship thereto. A sleeve 90 extends about and along the forward portion 44B of the shaft 44 and has a longitudinal slot 92 receiving an end 88A of the pin 88 such that the shaft 44 can undergo longitudinal movement through the sleeve 90 along the longitudinal axes 60, 84 of the housing 42 and shaft 44 but not undergo rotation about the axes 60, 84 and relative to the sleeve 90 and thus to the housing 42.

The electromagnetic drive mechanism 46 is mounted in the central interior cavity 54 of the housing 42. The drive mechanism 46 includes a stator 94, a spool 96 and a series of electrical windings 98 disposed about the spool 96. The spool 96 is stationarily supported by the housing 42 in the central interior cavity 54 of the housing 42 at the cylindrical middle portion 52 thereof. The spool 96 has a central bore 100 defined therethrough aligned with the central openings 62, 64 at the opposite (or front and rear) end portions 56, 58 of the housing 42. The stator 94 is fixedly mounted on the shaft 44 about the middle portion 52 thereof and extends through the central bore 100 of the spool 96 in an electromagnetically coupled relationship with the electrical windings 98 about the spool 96 whenever an electrical current is moving through the windings 98.

The actuating arrangement 48 is mounted to the handle 50, is electrically connected to the electrical windings 98 of the electromagnetic drive mechanism 46, and is operable to actuate the drive mechanism 46 to cause repetitive reciprocal vibratory movement of the shaft 44 along its longitudinal axis 86 relative to the housing 42. The actuating arrangement 48 includes a trigger 102 reciprocally mounted to the handle 50 at a front upper location thereon immediately below the front end portion 56 of the housing 42. The trigger 102 extends from the exterior of the handle 50 into the interior compartment 84 of the handle 50. The actuating arrangement 48 also includes an electronic control module 104 provided in the interior compartment 84 of the handle 50 and an electrical power supply cable 106 connected to the module 104 through the bottom end 50A of the handle 50. Conductive wires 106 extending through passageways 50B, 50C in the handle 50 interconnect the trigger 102, module 104 and electrical windings 98 on the spool 96 so as to form an electrical circuit therebetween. The trigger 102 is an electrical switch biased to normally assume an extended position in which the electrical circuit is maintained in a non-conductive or broken condition. The electrical circuit is closed and thus the module 104 is activated and the electrical windings 98 are energized by depressing the trigger 102. When the trigger 102 is depressed, the electronic control module 104 is activated to apply predetermined pulses to the electrical windings 98 so as to actuate the stator 94 and thus the shaft 44 into repetitive reciprocal vibratory type of movement relative to the housing 42.

The force applied by the elongated shaft 44 can be adjusted by the incorporation in the apparatus 40 of an arrangement in the form of a knob 108 disposed on a rear end 44D of the shaft 44 and first and second springs 110, 112 disposed about the rearward portion 44C of the shaft 44 respectively interiorly between the stator 94 and rear end 42A of the housing 42 and exteriorly between the knob 108 and rear end 42A of the housing 42. Front and rear plugs 114, 116 are fixedly secured by screws 118, 120 in the front and rear central openings 62, 64 in the front and rear end portions 56, 58. The front plug 114 provides a front stop which is abutted by the pin 88. The rear plug 116 has an internal shoulder 116A having opposite sides against which the first and second springs 110, 112 respectively abut. The knob 108 is threadable about the rear end 44D of the shaft 44 toward and away from the rear end 42A of the housing 42 such that by turning the knob 108 the return force imposed by the springs 110, 112 on the stator 94 and shaft 44 can be increased or decreased to thereby adjust the amount vibratory force applied to the human body at the front end of the shaft 44.

Also, a plurality of force transmitting elements 122 of different configurations are adapted to be fitted to a hex shaped segment 124 of the front end 44E of the shaft 44 and placed against a part of the human body to be treated. Other polygonal shapes may be used, particularly to resist rotation, as explained below. The different configurations of the elements 22 allow for the application of force in different ways to the human body. The adjustor apparatus 40 has a mode of operation similar to that of a jack hammer or the like. In the case of the apparatus 40, vibratory impacts are transmitted at the front end 44E of the shaft 44 by the selected one of the force transmitting elements 122 when it is placed against the desired part of the human body.

Figure 3:
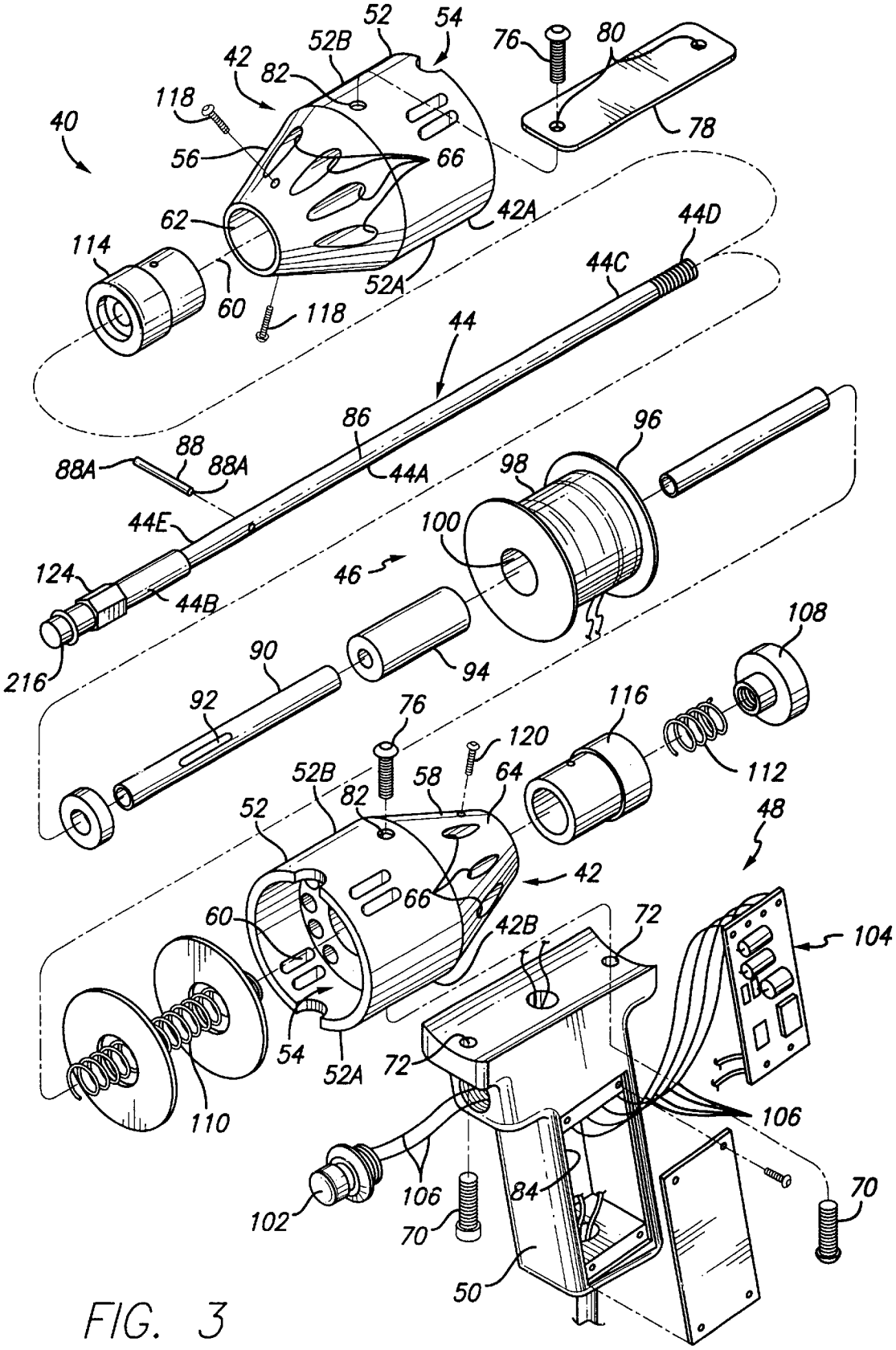
FIG. 3 is an exploded perspective view of the apparatus of FIG. 2.
Figures 4, 5:
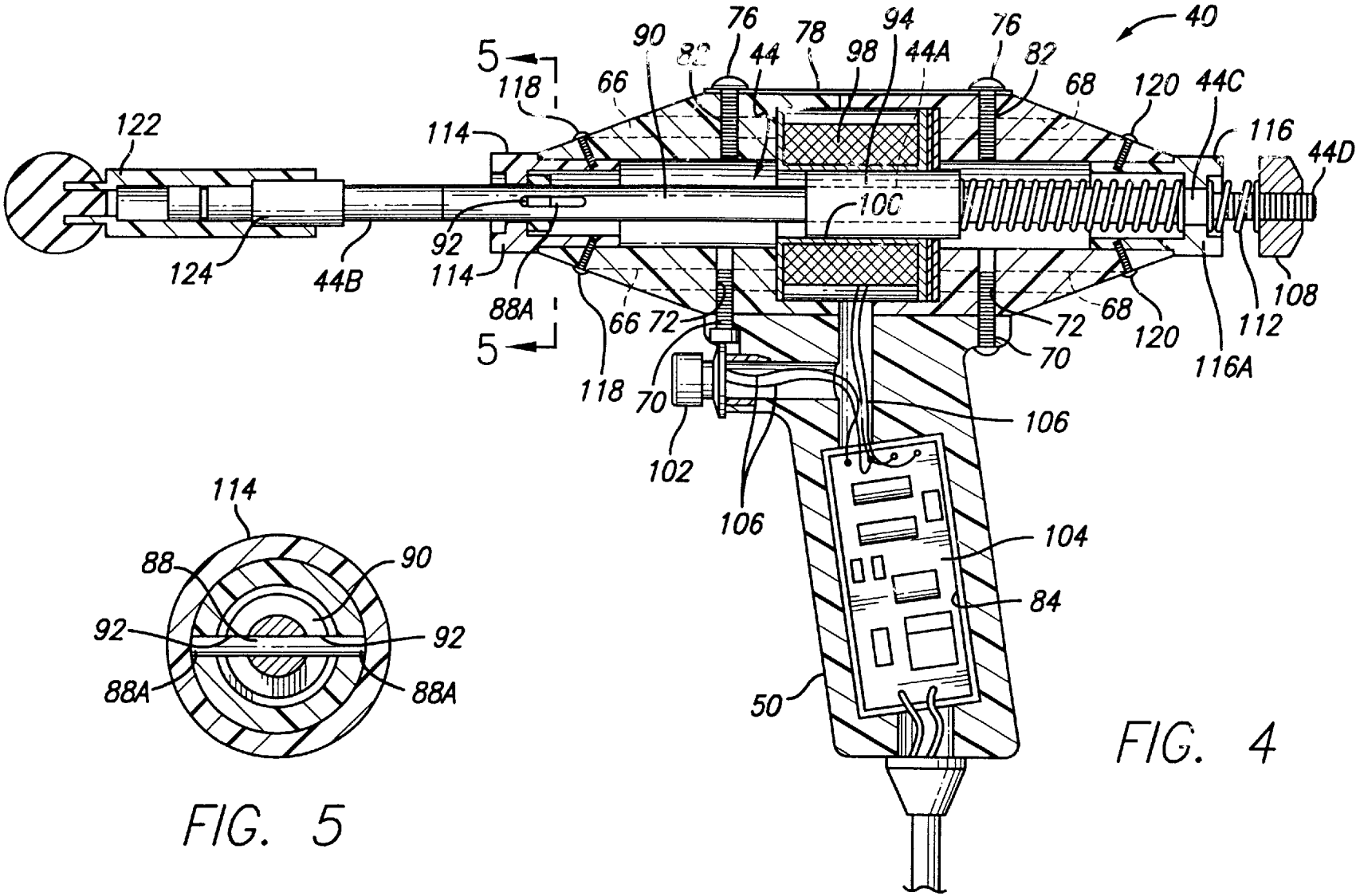
FIG. 4 is a longitudinal sectional view of the apparatus of FIG. 2.
FIG. 5 is an enlarged cross sectional view of the apparatus taken along line 5—5 of FIG. 4.
Figure 6:
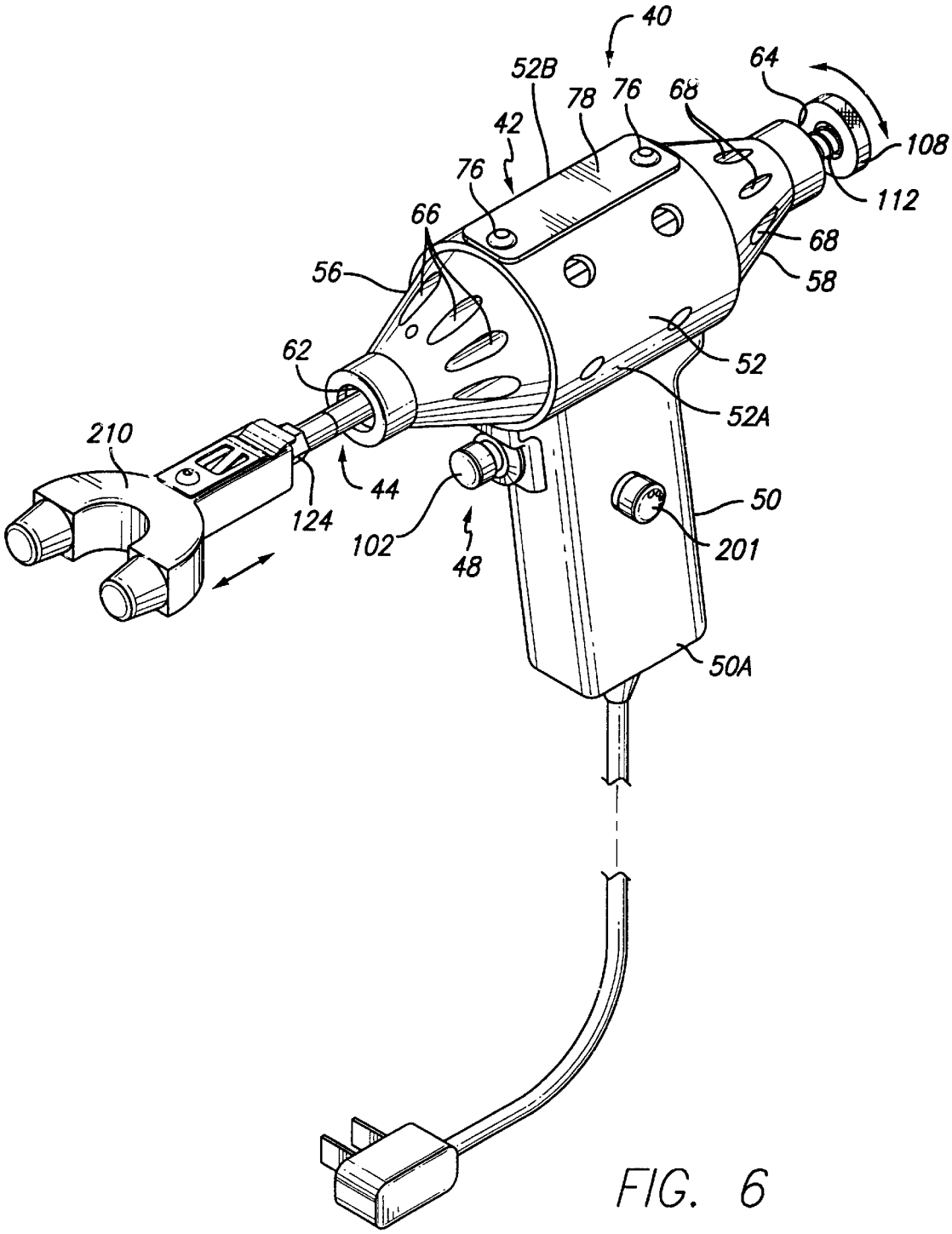
FIG. 6 is a perspective view of a second embodiment of the present invention showing the variable frequency controller and a force transmitting element showing attachment with a spring latch.
Figure 9:
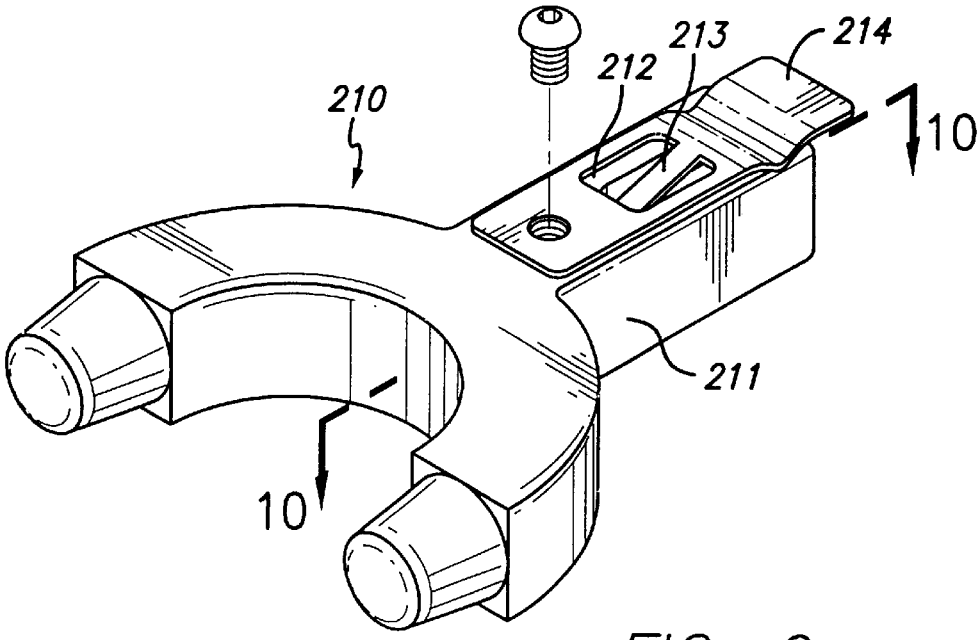
FIG. 9 is a perspective view of a force transmitting element showing a spring latch.
Figure 10:
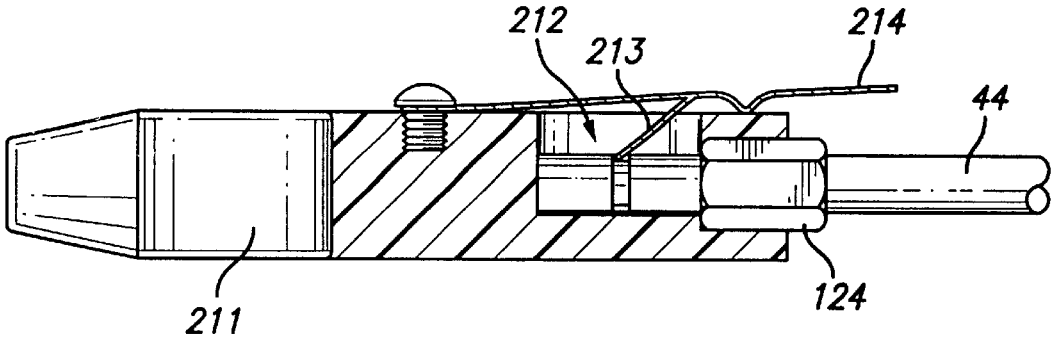
FIG. 10 is a cross-sectional view line 10—10 of FIG. 9.
Figure 11:
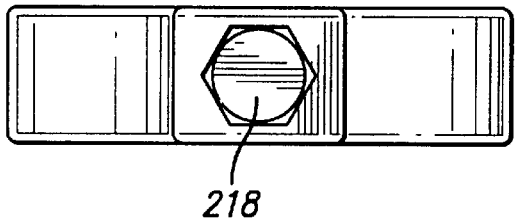
FIG. 11 is an end elevational view of a force transmitting element showing the hexagonal aperture for receiving the hex head on the shaft.

The force transmitting elements can be made to be easily interchangeable using a spring-latch. The force transmitting element with a spring-latch, referred to hereinafter generally as the spring-latch head 210, is illustrated in FIGS. 6, 9 and 10. Referring now to FIGS. 9 and 10, an aperture 212 is formed in the neck 211 of the spring-latch head 210 for receiving a tongue 213 of a spring-latch 214. The spring-latch 214 is preferably attached to the neck 211 with a screw, but may also be attached with solder, adhesive, or other means. The tongue 213 is normally biased downward into the aperture 212. To latch the spring-latch head 210 in place, the front-end of the shaft 44 is inserted into the neck 211 of the spring-latch head 210 until the tongue 213 is forced up and over the front end of the shaft and snaps into the groove 215 formed in the shaft for receiving the tongue 213. Alternatively, a flange 216 may be used instead of the groove 215, as shown in FIG. 3, in which case the tongue is forced up and over the front end of the shaft 44 and snaps into place behind the flange 216. To unlatch the spring-latch head 210 for easy interchangeability, the end of the spring-latch 214 is depressed, forcing the tongue 213 up enough for the groove (or flange) to bypass the tongue 213 as the shaft 44 is withdrawn from the neck 211.

Referring now to FIG. 6, a second embodiment of the present invention utilizes a variable frequency controller 201 attached to the handle 50 and electrically connected to the electronic control module 104 provided in the interior compartment 84 of the handle 50. The variable frequency controller 201 can be used to adjust the current applied to the electrical windings 98 in pulses of various periods so as to actuate the stator 94 and thus the shaft 44 into repetitive reciprocal vibratory type of movement relative to the housing 42 in varying frequencies. Variable frequency controllers can be electromechanical or electronic, as are known in the art.

Figure 7:
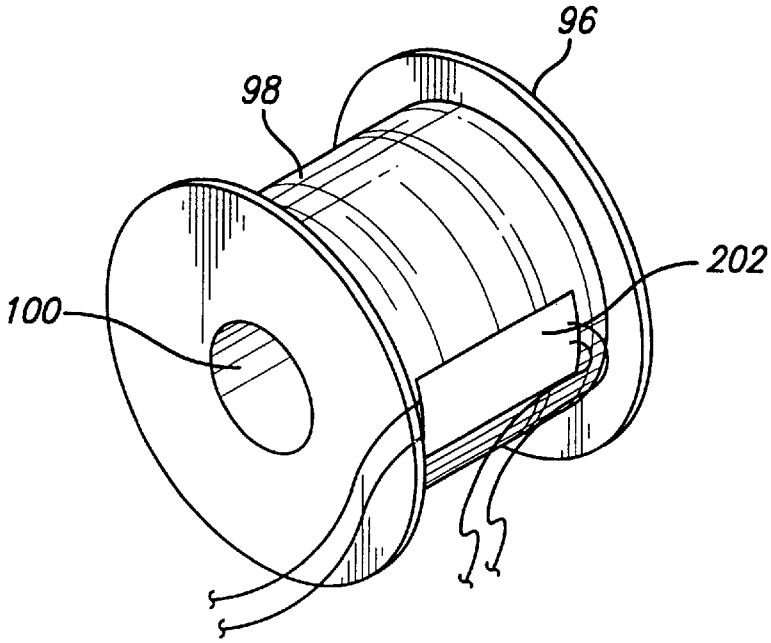
FIG. 7 is a perspective view of the thermal cut-off switch attached to the electromagnetic drive mechanism.
Figure 8:
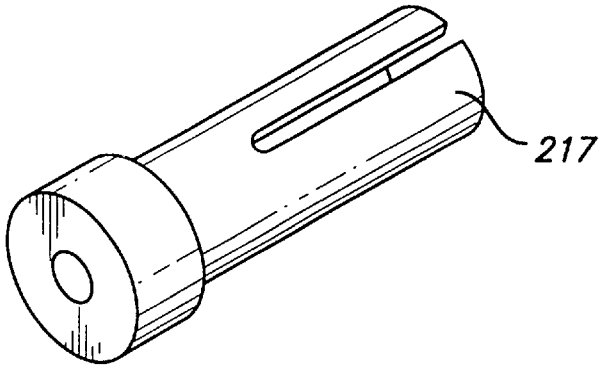
FIG. 8 is a perspective view of the slotted bushing.

During use the device can generate substantial heat due to the heating of the electrical windings which, in turn, heat the portions of the housing. FIG. 7 illustrates a thermal cut-off switch 202 which is designed to cut-off power to the electrical windings 98 when the switch 202 reaches a given temperature. The thermal cut-off switch is preferably a bi-metal switch that forms an open in the circuitry when the temperature reaches 135° C. For optimal temperature sensitivity, the thermal cut-off switch 202 is preferably attached directly to the greatest source of heat generation, the electrical windings 98. The thermal cut-off switch 202 is preferably applied with room-temperature vulcanizing silicone rubber, known in the art as RTV silicone rubber, but any other means of attachment that secures the switch and that can withstand device temperatures will suffice.

FIGS. 6, 8, 9, 10 and 11 illustrate a suite of structures that work together to resist rotation when the device is in use. Two points of rotation must be controlled: the rotation of the handle 50 relative to the shaft 44, and the rotation of the shaft 44 relative to the force-transmitting elements. To prevent rotation between the handle 50 and the shaft 44, a slotted bushing 217 (shown in FIG. 8) is used in place of front plug 114 or rear plug 116 (shown in FIG. 3) and is secured by screws 118 in the front central opening 62 in the front portion 56 of the housing 42. Pin 88 extends through the slot and prevents the slotted bushing 217—and therefore the attached housing—from rotating relative to the shaft 44. To prevent rotation between shaft 44 and the force-transmitting element 122 and 210, the shaft 44 utilizes a hex-shaped segment 124 of the front end 44E of the shaft 44 which fits snugly in a mated, hex-shaped aperture 218 in the neck 211 of the force-transmitting element. The mated hex-shaped shaft and aperture prevent the prevents the rotation of the shaft 44 relative to the force-transmitting elements 122 and 210. While hex-shaped is preferred, other polygonal-shaped apertures and mated segments that prevent the shaft from rotating within the aperture in the neck are acceptable.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A chiropractic adjustor device comprising:

a) a housing having a central interior cavity and a pair of opposite end portions;

b) an electromagnetic drive mechanism mounted in the interior cavity of the housing;

c) a shaft extending through the electromagnetic drive mechanism and through openings in the opposite end portions of the housing;

d) means for actuating the electromagnetic drive mechanism to cause repetitive reciprocal movement of the shaft along a longitudinal axis of the shaft and relative to the housing wherein the actuating means further includes an electronic control module; and e) means attached to the housing for gripping to hold the device; and f) means for resisting rotation of the gripping means relative to the shaft and rotation of the shaft relative to a force-transmitting element the apparatus relative to a user's grip.

2. The device according to claim 1 further comprising means connected to the electronic control module for cutting-off power to the electromagnetic drive mechanism upon reaching a certain temperature.

3. The device according to claim 1 further comprising means connected to the electronic control module for changing the frequency of the reciprocation.

4. The device according to claim 1 wherein the means for resisting rotation includes a force-transmitting element which is attached to the shaft with a polygonal-shaped aperture for receiving a mated polygonal-shaped end of the shaft.

5. The device according to claim 1 wherein the force transmitting element is attached to the shaft using a spring-latch.

6. The device according to claim 1 wherein the means for resisting rotation comprising:

a) a pin mounted across the shaft in a transverse relationship thereto;

b) a slotted bushing attached to one of the opposite end portions of the housing;

such that the pin fits into a slot of the slotted bushing and restrains the shaft from rotating relative to the housing.

7. The device according to claim 1 wherein the housing and opposite end portions all have passages adapted to enhance heat dissipation from the housing.

8. The device according to claim 2 wherein the means for cutting-off power to the electromagnetic drive mechanism is a thermal cut-off switch.

9. The device according to claim 3 wherein the means for changing the frequency of reciprocation is a variable-controlled switch.

* * * * *